US008376724B2

(12) United States Patent
Shinozaki

(10) Patent No.: US 8,376,724 B2
(45) Date of Patent: Feb. 19, 2013

(54) GEAR PUMP ENABLING EFFICIENT PUMP CAPACITY CHANGE

(75) Inventor: Keisuke Shinozaki, Kanagawa (JP)

(73) Assignee: TBK Co., Ltd., Tokyo (JP)

( * ) Notice: Subject to any disclaimer, the term of this patent is extended or adjusted under 35 U.S.C. 154(b) by 725 days.

(21) Appl. No.: 12/596,766

(22) PCT Filed: Aug. 10, 2007

(86) PCT No.: PCT/JP2007/065975

§ 371 (c)(1),
(2), (4) Date: Oct. 20, 2009

(87) PCT Pub. No.: WO2008/142806

PCT Pub. Date: Nov. 27, 2008

(65) Prior Publication Data

US 2010/0086422 A1 Apr. 8, 2010

(30) Foreign Application Priority Data

May 21, 2007 (JP) ..... 2007-133683

(51) Int. Cl.
*F03C 4/00* (2006.01)
*F04C 14/18* (2006.01)
*F04C 2/00* (2006.01)

(52) U.S. Cl. ..... 418/21; 418/26; 418/27; 418/206.1

(58) Field of Classification Search .... 418/206.1–206.9, 418/204, 205, 21, 24, 26–27, 74
See application file for complete search history.

(56) References Cited

U.S. PATENT DOCUMENTS

| | | | | |
|---|---|---|---|---|
| 2,262,331 | A | 11/1941 | MacNeil | |
| 3,446,118 | A * | 5/1969 | Kuhara | 418/21 |
| 4,740,142 | A * | 4/1988 | Rohs et al. | 418/21 |
| 6,283,735 | B1 | 9/2001 | Schreiber et al. | |
| 7,544,052 | B2 * | 6/2009 | Wockel et al. | 418/21 |
| 7,717,690 | B2 * | 5/2010 | Hoji et al. | 418/21 |
| 2007/0248481 | A1 * | 10/2007 | Lamparski | 418/206.1 |
| 2008/0044308 | A1 | 2/2008 | Hoji et al. | |

FOREIGN PATENT DOCUMENTS

| | | | |
|---|---|---|---|
| DE | 4121074 A1 * | 1/1993 | 418/21 |
| DE | 19847132 | 4/2000 | |
| EP | 0994257 | 4/2000 | |
| JP | 57-73880 | 5/1982 | |
| JP | 2000-120559 | 4/2000 | |

* cited by examiner

*Primary Examiner* — Theresa Trieu
(74) *Attorney, Agent, or Firm* — Greenblum & Bernstein, P.L.C.

(57) ABSTRACT

An oil pump includes a drive gear, which rotates with a drive shaft, a driven gear, which meshes with the drive gear and is supported rotatable on a driven shaft, and a casing having a pump chamber, which accommodates the drive gear and the driven gear. The casing of the gear pump is provided with an intake port and a discharge port, which are in fluid communication with the pump chamber, so that oil is sucked through the intake port and discharged through the discharge port. A gear holder is provided in the casing such that the gear holder supports the driven gear rotatable and holds both sides of the driven gear while the gear holder itself is being supported axially movable by the driven shaft. The gear holder holding the driven gear moves axially by receiving a biasing force and also a pressing force acting against the biasing force.

7 Claims, 9 Drawing Sheets

GEAR PUMP ENABLING EFFICIENT PUMP CAPACITY CHANGE

TECHNICAL FIELD

The present invention relates generally to a gear pump that comprises two intermeshing gears for transporting a fluid and particularly to a gear pump the meshing width of whose two gears is variable.

TECHNICAL BACKGROUND

Generally, the capacity of a gear pump is determined by, for example, the tooth depth and tooth width of the gears, and the discharge flow rate is determined by the capacity and the rotational speed of the gears (i.e., the rotational speed of the pump). In a case where this gear pump is used as an oil pump for supplying lubricating oil into, for example, a vehicular engine, the capacity of the oil pump is set to supply oil at a sufficient amount for the lubrication even if the output of the engine as driving source is small, and therefore, the rotational speed of the pump is relatively low. On the other hand, as the output of the engine becomes larger, and thereby the rotational speed of the pump grows higher, the oil being supplied into the engine becomes excessive. In this condition, there is a possibility that a large driving force is consumed by the oil pump, which may lead to a power loss of the engined.

As a gear pump for solving this problem, there is a variable capacity type gear pump wherein, as the rotational speed of the pump becomes higher, both the drive gear and driven gear or one of them is correspondingly moved axially to reduce the meshing width of the gears and thereby reducing the capacity (refer, for example, to Japanese Laid-Open Patent Publication No. 2000-120559, and to Japanese Laid-Open Patent Publication No. S57-73880). Japanese Laid-Open Patent Publication No. 2000-120559 discloses a gear pump in which the driven gear is held axially by two side plates, with the support shaft of the driven gear being supported by these side plates. In this gear pump, a biasing force is provided on the back of one of the side plates while this biasing force is counteracted by a pressing force that is provided on the back of the other side plate, the pressing force being correspondent to the discharged fluid pressure. In this design, the driven gear, which is sandwiched between both the side plates, moves axially to the position where the pressing force is balanced against the biasing force. As a result, the meshing width of the driven gear with the drive gear varies in correspondence to the discharged fluid pressure.

DISCLOSURE OF THE INVENTION

Problems to be Solved by the Invention

In the gear pump disclosed in Japanese Laid-Open Patent Publication No. 2000-120559, the discharged fluid pressure is received on the whole back surface of the other side plate to exert the pressing force. As a result, the moving of both the side plates and the driven gear axially consumes a large amount of discharged fluid for generating a high pressure. Because of this factor, there is a problem that when the pump capacity is changed, the pressure of the fluid being discharged can fall to a level that affects the flow rate of the oil being discharged and supplied from the gear pump.

The present invention is to solve such a problem, and the object of the present invention is to provide a variable capacity type gear pump that enables efficient pump capacity change without affecting the oil discharge and supply rate.

Means to Solve the Problems

A gear pump according to the invention comprises a first gear, which is fixed on a first support shaft extending back and forth and which rotates together with the first support shaft, a second gear, which is supported rotatable on a second support shaft disposed parallel to the first support shaft and which meshes with the first gear, and a casing, which provides an installation space for accommodation of the first gear and the second gear and which supports the first support shaft rotatable and supports the second support shaft. Furthermore, the casing is provided with an intake port, which is in fluid communication with the installation space, and with a discharge port, which is in fluid communication with the installation space. For the operation of the gear pump, the first gear and the second gear meshing with each other are rotated by the rotation of the first support shaft, so that a fluid is sucked through the intake port and is discharged through said discharge port. The gear pump further comprises a gear holder in the installation space, and the gear holder, while it is supporting the second gear rotatable and holding both sides of the second gear, itself is supported and mounted axially movable on the second support shaft. The gear holder is subjected to an axial biasing force from a bias member, which biasing force biases the gear holder to one side in the axial direction of the support shafts, and subjected also to a pressing force that pushes the gear holder, against said biasing force, to the other side in the axial direction of the support shafts. As a result, the gear holder holding the second gear moves in the axial direction of the support shafts.

In the gear pump, which is arranged as described above, the gear holder comprises one side wall that includes a ring-shaped shank part and a cylindrical side wall part, and a cylindrical other side wall. The second gear is supported rotatable on the shank part, and one side face of the second gear is in close contact with one side face of the one side wall while the other side face of the second gear is in close contact with one side face of the other side wall. It is preferable that the other side face of the one side wall or the other side face of the other side wall be provided with a piston, which is subjected to the pressing force.

In addition, in the gear pump, which is arranged as described above, the gear holder is provided with an internal flow passage, which connects, in fluid communication, the discharge port to an enclosed space provided on the back side of the piston. It is preferable that the pressing force act on the piston when the piston is subjected to the fluid pressure being supplied through the internal flow passage into the enclosed space.

Advantageous Effects of the Invention

In the gear pump according to the invention, the gear holder holds the second gear rotatable, and the gear holder holding the second gear is supported axially movable on the second support shaft. In this arrangement, on the part of the gear holder where the second gear is supported, a sliding friction occurs in the circumferential direction (i.e., in the direction perpendicular to the shaft) when the second gear rotates. On the other hand, on the surface of the second support shaft, a sliding friction occurs in the axial direction when the gear holder moves in the axial direction. Because each sliding friction occurs on a different part, these frictional resistances do not interfere with each other. As a result, the rotation of the second gear and the axial movement of the gear holder are secure and reliable, improving the operation reliability of the gear pump and the efficient variability of the pump capacity.

In addition, the pressing force acts directly on the gear holder because the piston, which is to be subjected to the pressing force, is provided on the other side face of the one side wall or the other side face of the other side wall. This arrangement prevents any loss in conveying the pressing force, so the pressing force, which is used for the gear holder to move axially, itself can be reduced for increasing the operational efficiency of the gear holder.

Furthermore, the internal flow passage is provided inside the gear holder for connecting, in fluid communication, the discharge port to the enclosed space, which is provided on the back side of the piston around the outer periphery of the second support shaft, and the pressing force is made to act on the piston by leading the fluid into this enclosed space. This arrangement makes the pressing force available without increasing the number of necessary components, and thus presents a possibility that the gear pump be manufacturing with a reduced cost.

DESCRIPTION OF THE PREFERRED EMBODIMENTS

Figure 1:
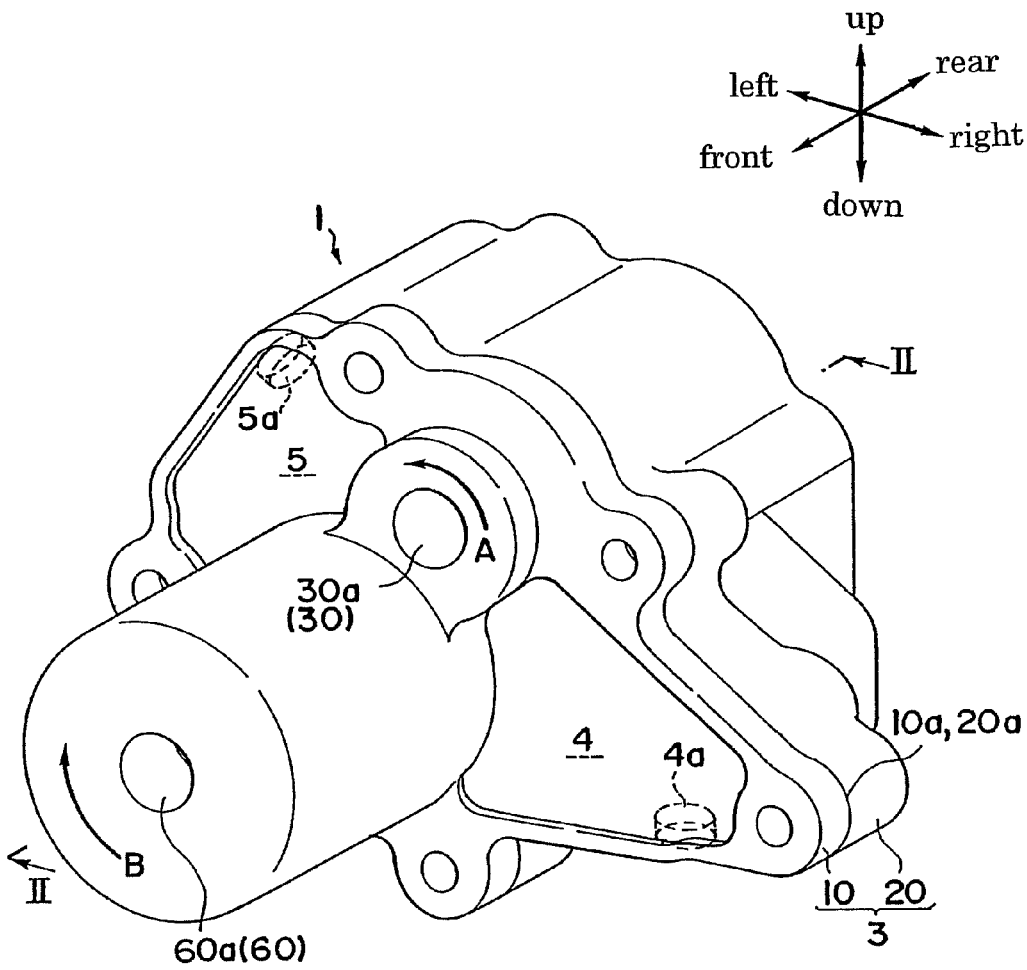
FIG. 1 is a perspective view of an oil pump according to the present invention.

Now, an embodiment of the invention is described with reference to these drawings. An oil pump 1 is shown in FIG. 1 through FIG. 8 as an example of gear pump according to the invention. For the sake of descriptive convenience, the directions of the oil pump are defined as indicated by arrows "front", "rear", "up" and "down" in FIG. 2, and the directions that are perpendicular to the paper that carries the drawing are defined as "right" and "left" directions. This oil pump 1, which is mounted in a vehicle (not shown) and uses an engine as driving source, takes in lubricating oil pooled in an oil tank (for example, an engine oil pan), which is provided in the vehicle, and discharges it into lubricating oil passages each connected to an appropriate part of the engine.

The oil pump 1 is an external contact type gear pump and mainly comprises a casing 3, a return spring 6 (e.g., a biasing member), a drive gear 31 (e.g., a first gear), a driven gear 61 (e.g., a second gear), a drive shaft 30 (e.g., a first support shaft), a transmission shaft 30*c*, a driven shaft 60 (e.g., a second support shaft) and a gear holder 110.

The casing 3 forms the periphery of the oil pump 1 and accommodates the respective components or members described below. The casing 3 itself is divided at the center in the front and rear direction as shown in FIG. 1 and FIG. 2 and comprises a front casing 10 and a rear casing 20, which are joined to each other on faying surfaces 10*a* and 20*a* and are fastened, for example, with bolts in the front and rear direction.

Figure 2:
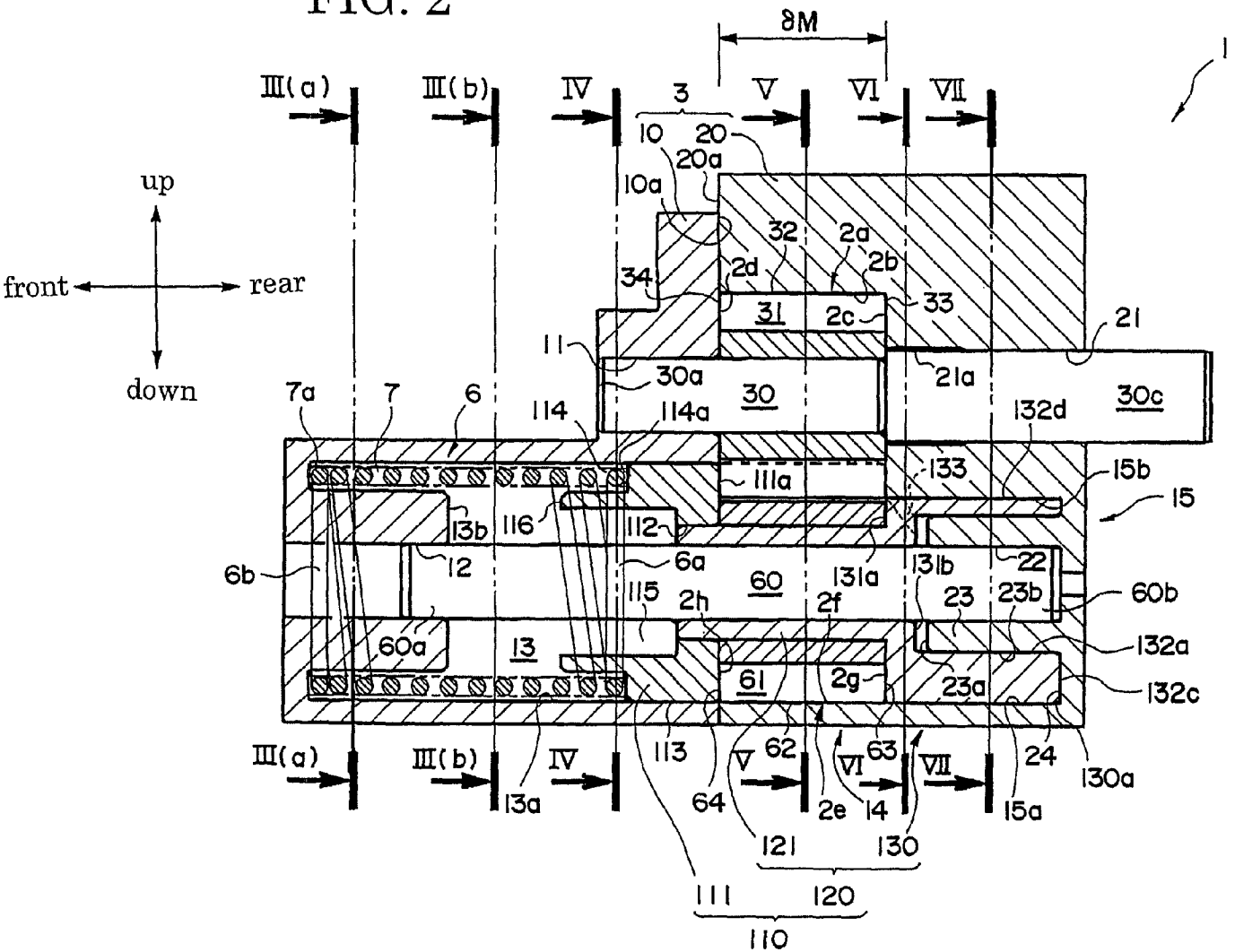
FIG. 2 is a sectional view taken in the direction indicated by arrows II-II in FIG. 1.
Figure 3A:
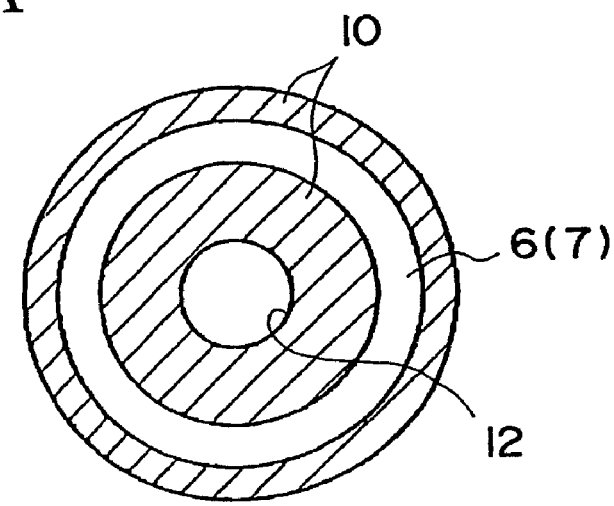
FIG. 3A is a cross-sectional view taken in the direction indicated by arrows III(a)-III(a) in FIG. 2.
Figure 3B:
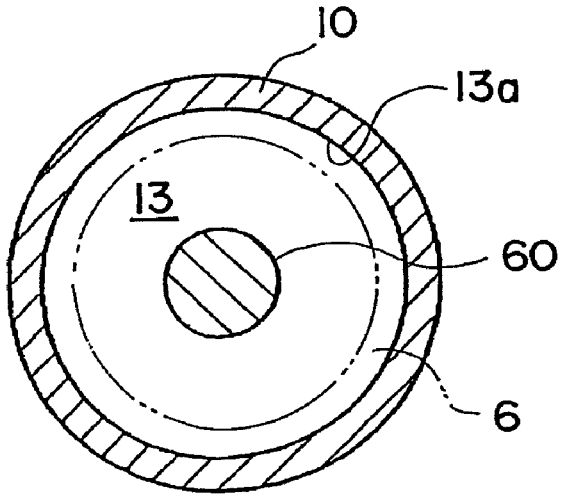
FIG. 3B is a cross-sectional view taken in the direction indicated by arrows III(b)-III(b) in FIG. 2.
Figure 4:
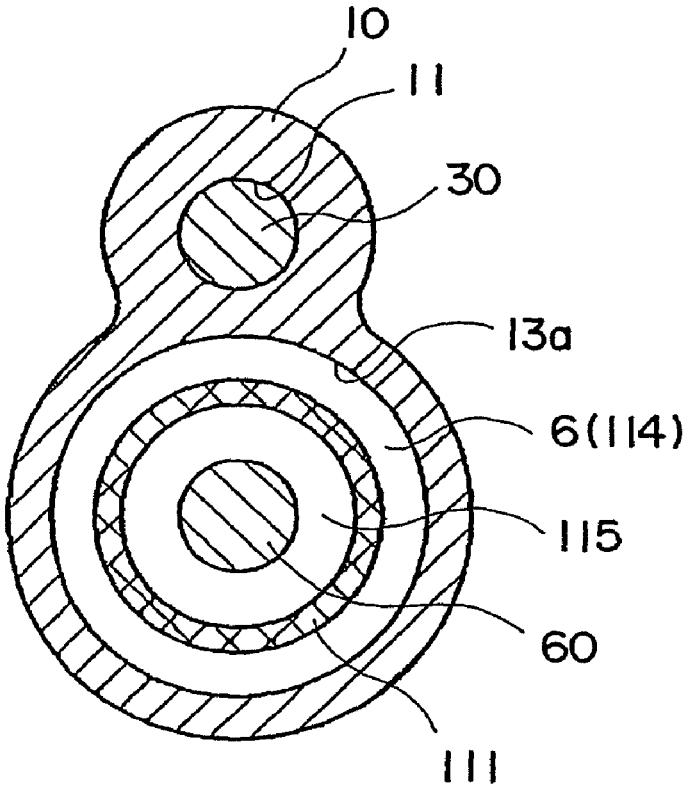
FIG. 4 is a cross-sectional view taken in the direction indicated by arrows IV-IV in FIG. 2.
Figure 4:
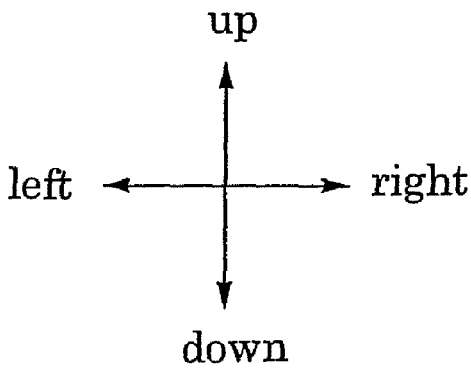

In the upper part of the front casing 10, a circular drive shaft support bore 11 is provided passing through the casing in the front and rear direction as shown in FIG. 2. On the other hand, at the lower part of the front casing 10, a front side space 13, which defines a cylindrical hollow part, is provided extending forward from the faying surface 10*a*. This front side space 13 is a cylindrical space, which is defined by a front end surface 13*b* on the front side of the casing and is surrounded by the circumferential internal surface 13*a* of the cylindrical hollow part. In addition, through the front end surface 13*b*, a circular driven shaft support bore 12 is provided passing through the casing in the front and rear direction. The casing is so designed that the central axis of the front side space 13 and that of the driven shaft support bore 12 share the same axial line, and that this central axis of the front side space 13 and the driven shaft support bore 12 is parallel with the central axis of the drive shaft support bore 11. Furthermore, in continuity to the front side space 13, a spring retention space 7, which is a ring-shaped hollow part, is provided extending forward from the front end surface 13*b*, with a base surface 7*a* and a circumferential internal surface, which is continuous from the previously mentioned circumferential internal surface 13*a*.

Figure 5:
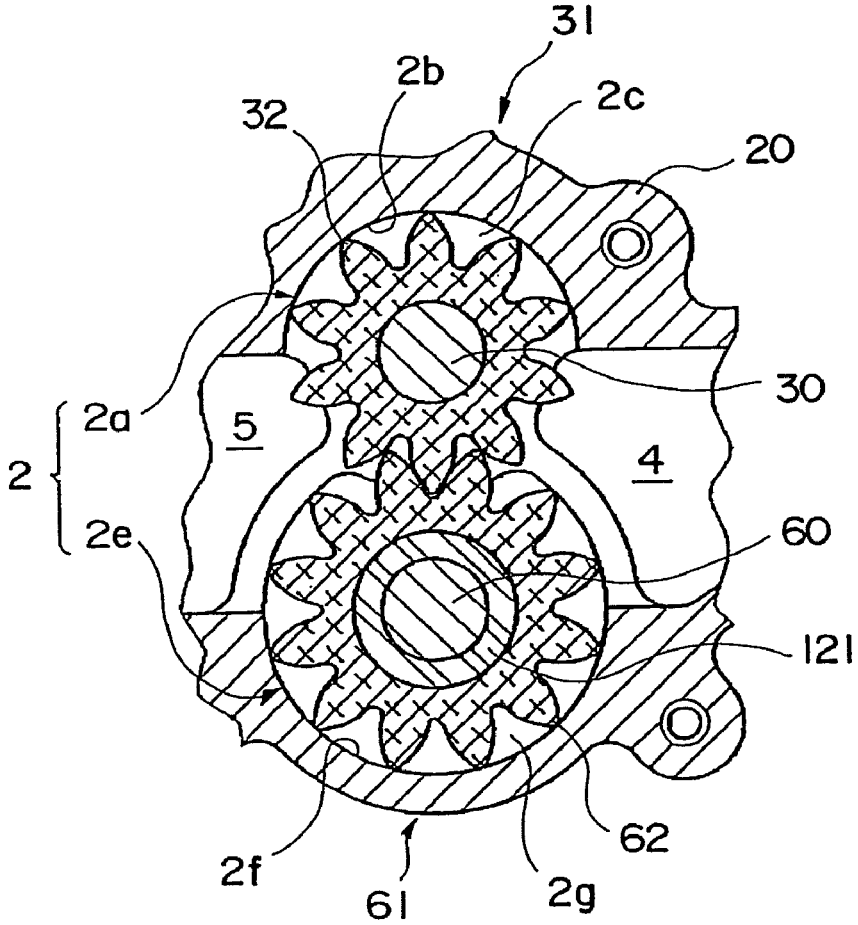
FIG. 5 is a cross-sectional view taken in the direction indicated by arrows V-V in FIG. 2.
Figure 5:
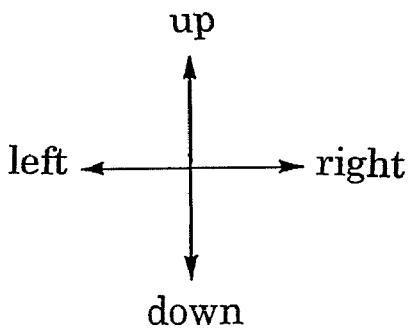

In the upper part of the rear casing 20, a semicircular hollow part is provided extending rearward from the faying surface 20*a* as shown in FIG. 5, and this hollow part is open downward and rightward and leftward. The upper part of this hollow part is defined by a semicircular drive-side circumferential internal surface 2*b*, and the rear part is defined by a drive-side first side surface 2*c*. Furthermore, a transmission shaft support bore 21 is provided passing through the drive-side first side surface 2*c*, and a recess 21*a* whose diameter is larger than that of the transmission shaft support bore 21 is provided at and near the front end of the transmission shaft support bore 21, and a bearing is provided in the recess 21*a*. In the casing, the transmission shaft support bore 21 has a larger diameter than the drive shaft support bore 11.

Figure 6:
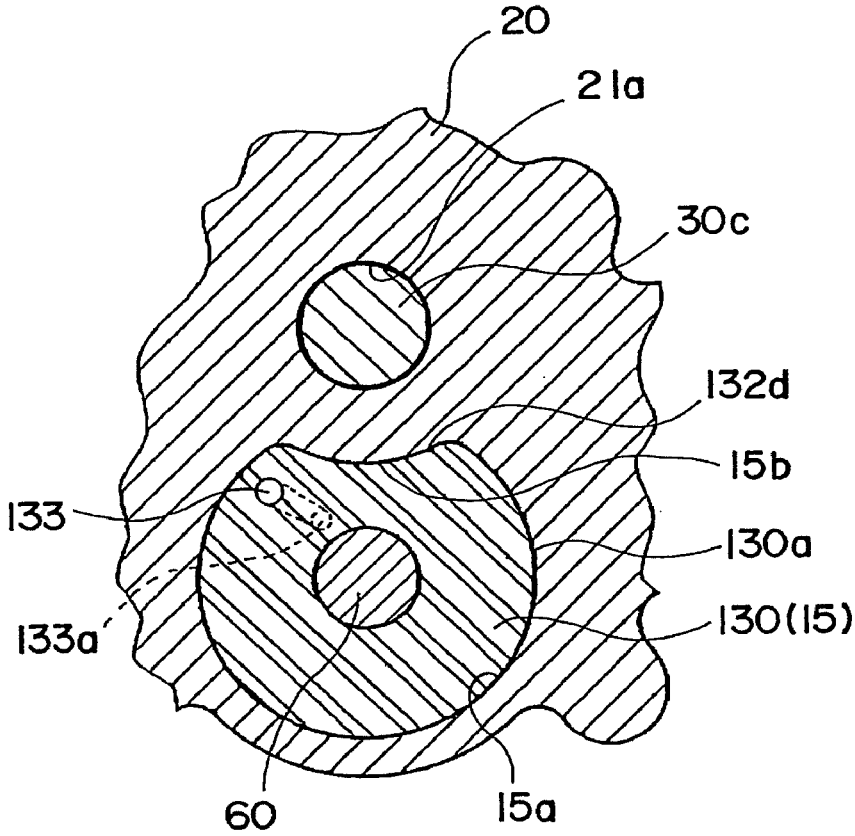
FIG. 6 is a cross-sectional view taken in the direction indicated by arrows VI-VI in FIG. 2.
Figure 6:
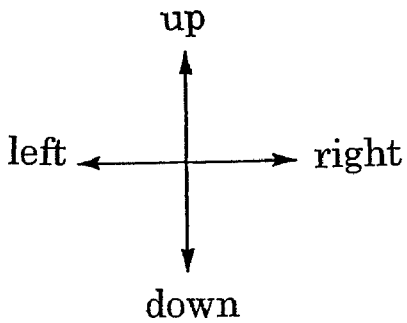
Figure 7:
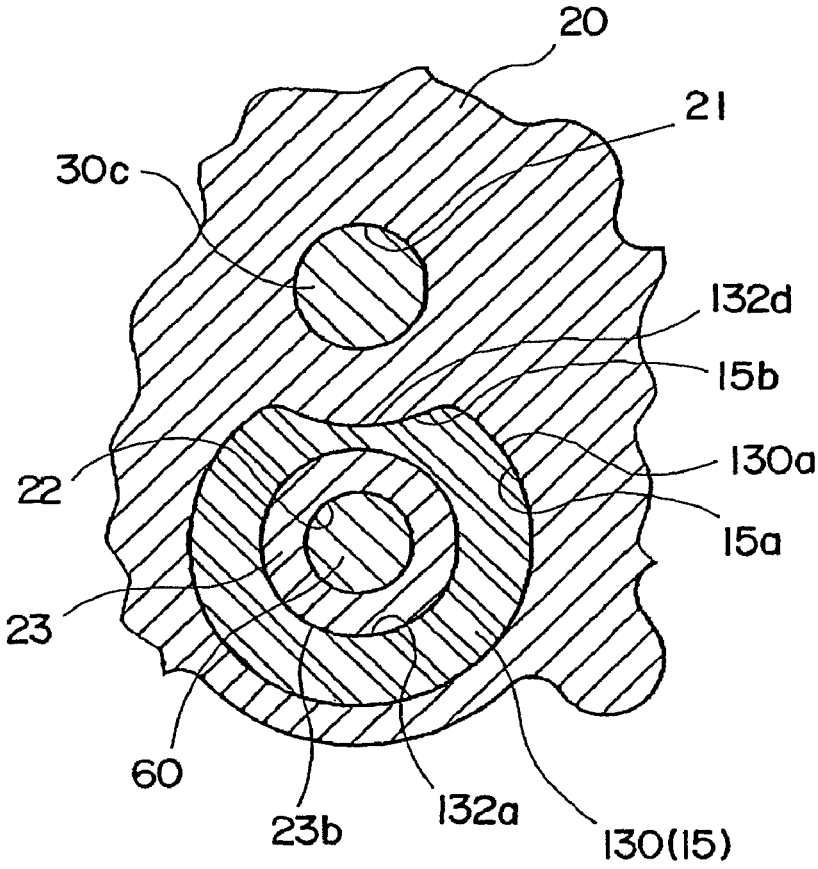
FIG. 7 is a cross-sectional view taken in the direction indicated by arrows VII-VII in FIG. 2.
Figure 7:
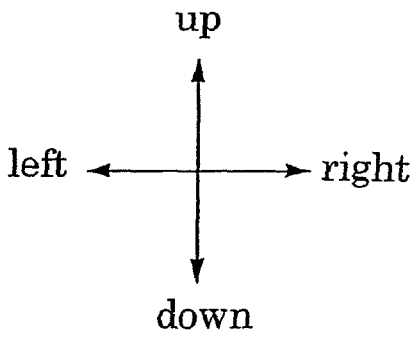

In the lower part of the rear casing 20, a rear side space 14 is provided opening as a semicircular hollow part that extends rearward from the faying surface 20*a* to the same surface as the drive-side first side surface 2*c* as shown in FIG. 5, with the rear side space 14 being open upward, rightward and leftward. The lower part of the rear side space 14 is defined by a semicircular driven-side circumferential internal surface 2*f*, whose radius is identical to that of the circumferential internal surface 13*a* of the front casing 10. Furthermore, a piston space 15 is provided as an approximately ring-shaped hollow part that extends from the rear side of the rear side space 14. As shown in FIG. 6 and FIG. 7, the periphery of the piston space is defined by an outwardly located circular circumferential internal surface 15*a* and a downwardly curved surface 15*b* while the inner boundary of the piston space 15 is defined by a cylinder-like circumferential internal surface 132*a*. The casing is so designed that the driven-side circumferential internal surface 2*f* and the outwardly located circumferential internal surface 15*a* have the same diameter and thereby the same continuous surface. In addition, the piston space 15 has, at its rear end, a ring-shaped base 24.

Furthermore, in the lower part of the rear casing 20, a tubular part 23 is provided at the center of the approximately ring-shaped piston space 15, like a cylinder extending in the front and rear direction, with its circumferential side surface 23*b* having a circular cross-section and with its front end surface 23*a* at the front end being located more rearward than the drive-side first side surface 2*c*. At the central part of the tubular part 23, a circular driven shaft support bore 22 is provided opening from the front end surface 23*a* rearward. The casing is so designed that the piston space 15, the driven shaft support bore 22 and the tubular part 23 share the same central axis, so they are seen as coaxial circles in cross-sectional view as shown in FIG. 7, and that the axis of these components is parallel with the central axis of the transmission shaft support bore 21.

The drive shaft 30 is cylindrical and extends in the front and rear direction. The front end 30*a* of the drive shaft is located approximately at the peripheral surface of the front casing 10 while the rear end reaches the drive-side first side surface 2*c*. The transmission shaft 30*c*, which is provided as a one-piece body with the drive shaft 30, is also cylindrical with a diameter larger than that of the drive shaft 30 and extends in the front and rear direction. The front part of the transmission shaft extends to the drive-side first side surface 2*c* while the rear part protrudes beyond the peripheral surface of the rear casing 20. The driven shaft 60 is cylindrical with a diameter substantially equal to that of the rotational axis 30 and extends in the front and rear direction. The front part of the driven shaft extends into the central part of the driven shaft support bore 12 while the rear part extends to the bottom of the driven shaft support bore 22. As shown in FIG. 5, the drive gear 31 and the driven gear 61 are so oriented that the ridges of their teeth 32 and 62, respectively, extend in the front and rear direction.

The gear holder 110 comprises mainly a front wall 111 and a ring rear wall 120. The front wall 111, which extends in the front and rear direction, is approximately tubular having a circular opening 112 at its center, and the peripheral surface 113 of the tubular front wall has a diameter that substantially equals that of the circumferential internal surface 13*a* of the casing. In addition, the front wall 111 is provided at its peripheral front end with a ring-shaped spring retention space 114, which extends rearward with a bottom face 114*a* at the rear end of the spring retention space 114. Furthermore, the front wall 111 is provided with a cylindrical front hollow part 115 that is coaxial with the opening 112 and extends rearward from the front end. As a result, a ring-shaped front end 116 exists at the front end of the front wall 111 while a ring-shaped rear end surface 111*a* is at the rear end.

The ring rear wall 120 is a single component comprising a ring part 121 and a piston part 130. The ring part 121 is tubular and extends in the front and rear direction, and in the state shown in FIG. 2, the front end of the ring part is located at the rear end of the front hollow part 115 of the front wall 111 while the rear end is located substantially at the drive-side first side surface 2*c* in the front and rear direction. In addition, the internal circumference of the ring part 121 is a circular bore having a diameter that is substantially equal to that of the driven shaft 60 while the external circumference of the ring part 121 has a diameter that is substantially equal to that of the opening 112 of the front wall 111.

The piston part 130 is approximately cylindrical and extends in the front and rear direction, and in the state shown in FIG. 2, the front base surface 131*a*, which is the front end of the piston part, is located substantially at the drive-side first side surface 2*c* in the front and rear direction. The rear part of the piston part is provided with a ring-like rear bottom surface 132*c*. Furthermore, the piston part is provided with an circular bore, which passes through the central part of the piston part and is continuous to the internal circumference of the ring part 121. As a result, this circular bore also has the same diameter, which is substantially equal to that of the driven shaft 60. In addition, the peripheral surface 130*a* of the piston part 130, which is approximately circular in cross section, has a diameter that is substantially equal to that of the outwardly located circumferential internal surface 15*a* of the piston space 15. Moreover, the piston part 130 is provided at the upper periphery thereof with a curved surface 132*d* that curves downward. The curvature of this curved surface is identical to that of the curved surface 15b of the rear casing 20.

Furthermore, the piston part 130 is provided, at the central part thereof in cross section, with a cylindrical hollow part, which extends forward from the rear bottom surface 132*c*. This hollow part comprises a cylindrical circumferential side 132*a* as periphery, which is circular in cross section, and a ring-like rear bottom surface 131*b* at its front end. Here, the cylindrical circumferential side 132*a* of the hollow part has a diameter that is substantially equal to that of the side surface 23*b* of the tubular part 23.

The piston part 130 is provided with an inner passage 133 that connects internally the front base surface 131*a* and the rear bottom surface 131*b* in fluid communication. The inner passage 133 passes through the piston part, slanting from an upper front point to a lower rear point as shown in FIG. 2, as viewed from the right, and slanting from an upper left point to a lower right point as shown in FIG. 6, as viewed from the front in cross section. Furthermore, the inner passage 133 opens at the front end hole 133*a* in the vicinity of the upper end of the rear bottom surface 131*b*. By the way, the return spring 6 is a spirally wound thin metal wire and is used for accumulating the elastic energy gained from the resiliency of the metallic elastic body.

Up to this point, the respective components of the oil pump 1 have been described. However, in the following, the assembled state of these components is explained with respect to FIG. 2.

The drive shaft 30 is inserted in and supported rotatable by the drive shaft support bore 11, and the transmission shaft 30*c* is inserted in and supported rotatable by the transmission shaft support bore 21. The recess 21*a* reduces the sliding area of the transmission shaft 30*c* in the transmission shaft support bore 21 and thereby reduces sliding friction therebetween. Furthermore, the central axes of these shafts 30 and 30*c* coexist on the same line, and the rear end of the drive shaft 30 is coupled with the front end of the transmission shaft 30*c*, so that these shafts rotate as a one-piece body.

The drive gear 31 is accommodated in the hollow part that is provided in the upper part of the rear casing 20. This gear is oriented so that the ridges 32 of its teeth extend linearly in the front and rear direction, and it is supported by and fixed on the drive shaft 30. As a result, the drive gear rotates with the drive shaft 30 as if they were a one-piece body. In this state of the drive gear 31, the other side face 34, which is the front side of the drive gear 31, is in close contact sharing substantially a common plane with the drive-side second side surface 2*d*, which is a part of the faying surface 10*a* of the front casing 10 facing the other side face 34. Similarly, the tooth ridges 32 are in close contact with the drive-side circumferential internal surface 2*b*, and the one side face 33, which is the rear side of the drive gear 31, is in close contact with the drive-side first side surface 2*c*. Here, the drive-side second side surface 2*d*, the drive-side circumferential internal surface 2*b* and the drive-side first side surface 2*c* surround and define a semicircular drive-side pump chamber 2*a*. Because both the drive-side circumferential internal surface 2*b* and the tooth ridges 32 are designed to have substantially the same length in the front and rear direction, the backward and forward movement of the drive gear 31 in the drive-side pump chamber 2*a* is limited by the front casing 10 and the rear casing 20.

The front end 60*a* of the driven shaft 60 is inserted in the driven shaft support bore 12 while the rear end 60*b* is press-fit into and fixed in the driven shaft support bore 22, which is provided in the rear casing 20. By the way, the front casing 10 and the rear casing 20 are provided with two parts of positioning means, so when the front and rear casings are assembled by bringing the faying surfaces 10*a* and 20*a* close to each other, these parts of the positioning means are matched to each other. In this way, the casing as a whole takes its correct and exact internal dimensions in the up and down and left and right directions. In this case, one part of the positioning means comprises pin holes (not shown) that are provided at a respective corresponding position in the faying surfaces 10*a* and 20*a*, and a dowel, which is inserted therein. The other part of the positioning means comprises the driven shaft 60, which is inserted into the driven shaft support bore 12. In other words, the driven shaft support bore 12 has a slightly larger diameter than that of the driven shaft 60, and when the front casing 10 and the rear casing 20 are assembled, the insertion of the front end 60*a* of the driven shaft 60 into this support bore functions to position these casings to each other. In the assembled state, the driven shaft support bore supports the inserted front end 60*a* of the driven shaft 60. As for the gear holder 110, while the driven gear 61 is supported rotatable on the outer periphery of the ring part 121, the front end of the ring part 121 is press-fit into and fixed in the opening 112 of the front wall 111 by bring the ring part forward from the rear side. As a result, the front wall 111, the ring rear wall 120 and the driven gear 61 are united as a one unit. Furthermore, the driven shaft 60 is inserted slidable into the central opening of the gear holder 110.

In this assembled state, the other side face 64, which is the front side surface of the driven gear 61, is in close contact sharing a substantially common plane with the rear end surface 111*a* of the front wall 111. Likewise, the tooth ridges 62 of the driven gear 61, which extend linearly in the front and rear direction, are in close contact with the driven-side circumferential internal surface 2*f*, and the one side face 63, which is the rear side of the driven gear 61, is in close contact with front base surface 131*a*. While the driven gear 61 and the drive gear 31 mesh with each other in the vicinity of the center in the vertical direction, the rear end side 111*a*, the driven-side circumferential internal surface 2*f* and the front base surface 131*a* surround and define a semicircular driven-side pump chamber 2*e*. Because the upper part of the driven-side pump chamber 2*e* is in fluid communication with the drive-side pump chamber 2*a*, the driven-side pump chamber 2*e* and the drive-side pump chamber 2*a* are together referred to as a pump chamber 2. The pump chamber 2 is open in the right and left direction. As shown in FIG. 1, an intake port 4 is provided in fluid communication on the right side while a discharge port 5 is provided in fluid communication on the left side.

The piston part 130 is inserted rearward from the front side into the piston space 15 after the curved surface 132*d* of the piston part 130 is matched with the curved surface 15*b* of the rear casing 20. In the assembled state, the curved surface 132*d* is in close contact with the curved surface 15*b* while the peripheral surface 130*a* is in close contact with the outwardly located circumferential internal surface 15*a*. As a result, the piston part 130 can slide axially in the piston space 15. The curved surface 132*d* is so designed that it is substantially identical to the curved path that the tooth ridges 32 of the drive gear 31 take in rotation. In addition, the front wall 111 is inserted forward from the rear side into the front side space 13 of the front casing 10, and as a result, the peripheral surface 113 is in close contact with the circumferential internal surface 13*a*. As a result, the front wall 111 can slide axially in the front side space 13. Because the circumferential internal surface 13*a* and the driven-side circumferential internal surface 2*f* are continuous to each other, the tooth ridges 62 of the driven gear 61 can come into close contact with the circumferential internal surface 13*a*.

The gear holder 110 can slide axially while its rotation around the driven shaft 60 is restricted because the curved surface 132*d* is fit in the curved surface 15*b*. In this state, the central axis of the driven shaft 60 is parallel with that of the drive shaft 30 and the transmission shaft 30*c*, and both these axes are at the same position in the right and left direction. Furthermore, the central axis of the driven shaft 60 shares the same line as the central axes of the gear holder 110 and the tubular part 23.

In addition, the return spring 6 is placed in the front side space 13, which is located more forward than the gear holder 110, in such a way for the spring to extend and contract in the front and rear direction. In this state, the rear end 6*a* of the return spring 6 is accommodated and kept in the spring retention space 114 and in contact with the bottom face 114*a* thereof while the front end 6*b* of the return spring 6 is accommodated and kept in the spring retention space 7 and in contact with the bottom face 7*a*. In this condition, the return spring 6 generates a biasing force that acts rearward on the gear holder 110. By the action of this force, the gear holder 110 slides axially rearward in the front and rear direction and stops at the position where the rear bottom surface 132*c* comes into contact with the base 24. In this state, the rear bottom surface 131*b*, the peripheral surface 132*a* of the tubular part and the front end surface 23*a* surround and define a ring-shaped enclosed space 25. By the way, even in this motionless state, the return spring 6 is generating a constant biasing force that acts rearward on the gear holder 110.

As the assembled state of the components has been described, now, the actions of the components when the oil pump 1 starts its operation are described in reference to FIG. 1 through FIG. 9. Note that the state depicted in FIG. 2 is defined as initial state.

When the engine starts and comes into an idling state, the transmission shaft 30*c* and the drive shaft 30, which is coupled with the transmission shaft 30*c*, are driven and rotated as shown in FIG. 2. As a result, both the gears 31 and 61, which mesh with each other, rotate. By the rotation of the gears, oil pooled in the oil tank is sucked through the inlet opening 4*a* of the intake port 4 into the pump chamber 2, and then the oil is pressurized there and sent through the outlet opening 5*a* of the discharge port 5 to the lubricating oil passages, which are provided in the engine case. It is so designed that the hydraulic pressure for supplying the oil is increased in correspondence to the increase in the required quantity of oil being fed.

In this operational state, because the drive gear 31 rotates in direction A indicated in FIG. 1, the oil that has flowed into the gap between the walls of the drive-side pump chamber 2*a* and the drive gear 31 is transported from the intake port 4 to the discharge port 5. On the other hand, the driven gear 61 rotates in direction B. As a result, the oil that has flowed into the gap between the walls of the driven-side pump chamber 2*e* and the driven gear 61 is transported from the intake port 4 to the discharge port 5. In the discharge port 5, the oil has a high pressure. However, because the drive gear 31 and the driven gear 61 start meshing with each other in the discharge port 5, the oil between their gear teeth is squeezed out to the discharge port 5, so the oil is securely transported from the intake port 4 to the discharge port 5.

In addition, part of the oil in the discharge port 5 is supplied is through the inner passage 133 into the enclosed space 25, and the hydraulic pressure of the oil being supplied into the enclosed space 25 acts forward on the rear bottom surface 131*b*. As a result, the gear holder 110 receives a resultant pressing force that acts axially forward against the above mentioned biasing force. In the initial state, the pressing force never overcomes the biasing force, so that the effect of the pressing force is negated by the biasing force. Therefore, the gear holder 110 remains stationary in this condition, as the biasing force pushes and keeps the rear bottom surface 132*c* in contact with the base 24.

Figure 9:
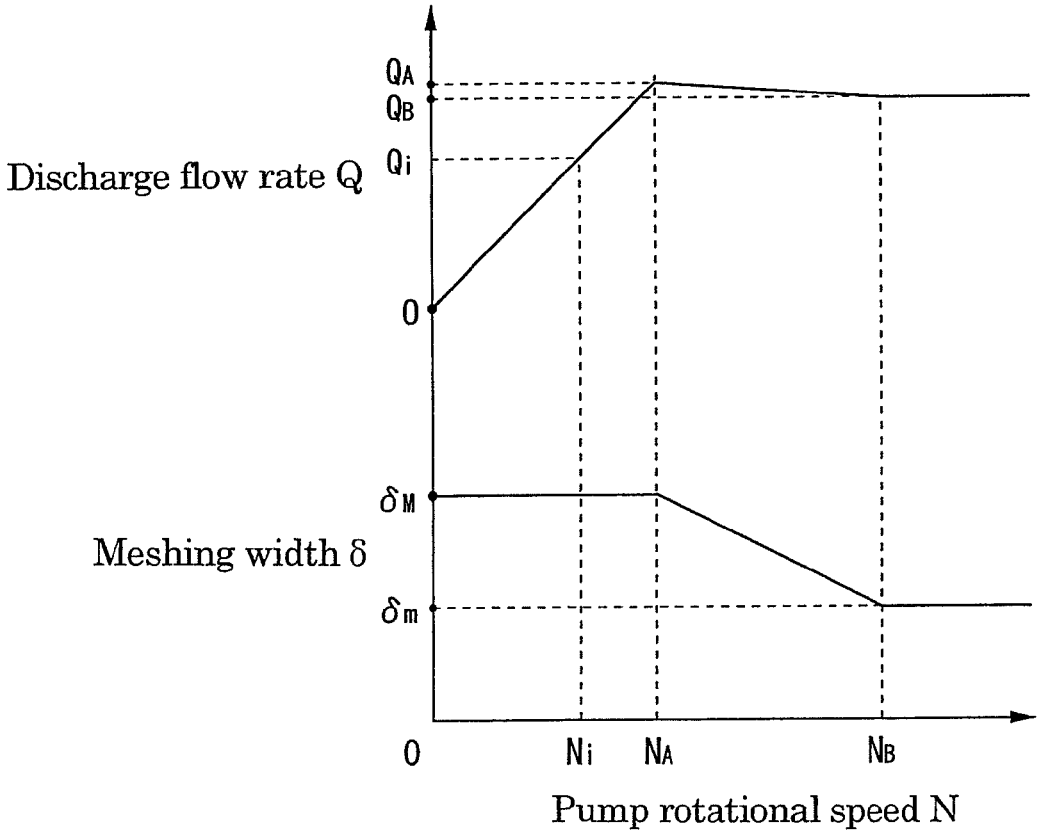
FIG. 9 is a graph describing relations between the rotational speed and discharge flow rate of the pump and the meshing width of the gears.

In FIG. 9, the graph depicts the rotational speed Ni of the pump when the engine is in idling. During the operation of the pump 1, the rotational speed of the pump rarely goes below this rotational speed Ni. The discharge flow rate Qi in this condition can secure the required quantity of oil to be fed for the lubrication. The meshing width δ of the drive gear 31 and the driven gear 61 at the time of the engine idling is referred to as maximum meshing width $\delta_M$. In the initial state, which is shown in FIG. 2, both the gears 31 and 61 are meshing with each other at the maximum meshing width $\delta_M$.

Then, the output of the engine is increased, and the pump rotational speed N reaches a first rotational speed $N_A$. At this time, the hydraulic pressure in the discharge port 5 has increased, and the pressure of the oil being supplied in the enclosed space 25 has also risen. As a result, the pressing force that has become larger than when the engine was idling now acts on the gear holder 110, so the pressing force substantially balances against the biasing force, both the forces acting on the gear holder 110 in the respective opposite axial directions.

When the pump rotational speed N exceeds the first rotational speed $N_A$, the pressing force overcomes the biasing force. As a result, the gear holder 110 is made to slide axially forward and compresses the spring 6, which resists the movement and generates a greater biasing force that matches the current pressing force. When the gear holder has slid to the balancing position, the meshing width δ of both the gears 31 and 61 has shortened. In this condition, although the upper part of the piston part 130 has seemingly come into the rotational path of the drive gear 31, because the upper part, i.e., the curved surface 132*d*, is curved downward with the substantially same radius as the path of the tooth ridges 32, the piston part never interferes with the tooth ridges 32 of the drive gear. In this state, the drive gear 31 and the driven gear 61 have some sections of their teeth not meshing at all, so the oil that has flowed to these sections stays there between the teeth and is not forced out from the discharge port 5. As a result, the capacity of the pump in this state has dropped if compared with the state of the pump when the engine is idling.

As shown in FIG. 9, the pump is so designed that the discharge flow rate Q is stable regardless of increases and decreases in the rotational speed N of the pump, by keeping a balance between the increase in the pump rotational speed N and the decrease in the pump capacity being made by the shortening of the meshing width δ, which in turn is the result of the increase in the pump rotational speed N. Because of this design, the oil pump 1 never discharges oil excessively even though the output of the engine rises.

Figure 8:
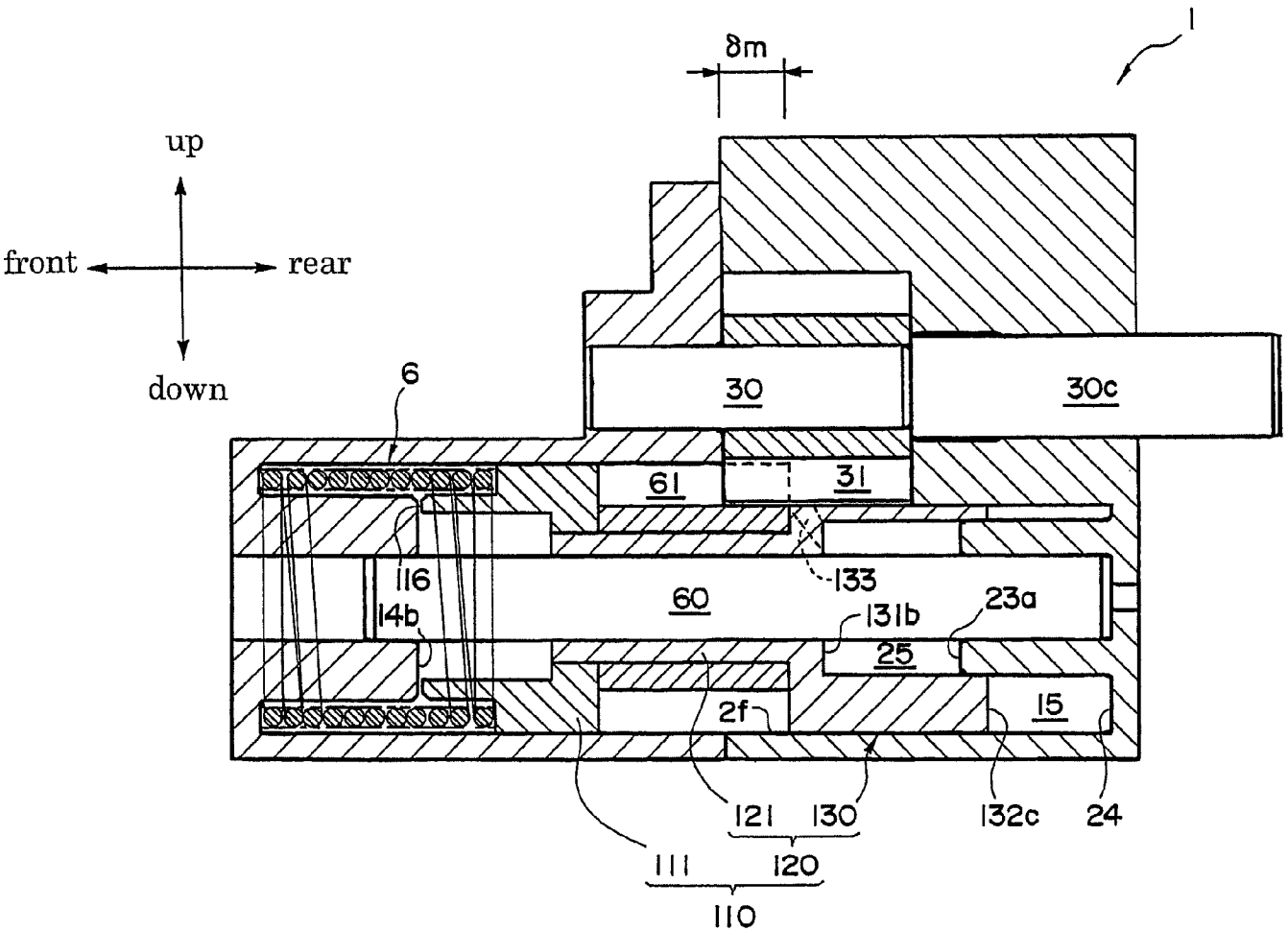
FIG. 8 is a sectional view showing the state of the gear holder, which is pressed forward and kept stationary.

Then, the pump rotational speed N reaches a second rotational speed $N_B$, and the pressing force becomes even larger. The gear holder 110 overcoming the biasing force and compressing the spring 6 slides axially farther forward until the front end 116 of the gear holder 110 comes into contact with the front end surface 13*b* of the front side space 13 as shown in FIG. 8. Because of this design, even if the pump rotational speed N increases beyond the second rotational speed $N_B$, the meshing width δ does not shorten any more and remains at the meshing width $\delta_M$ for the second rotational speed because the forward axial movement of the gear holder 110 is restricted. Therefore, the meshing width $\delta_M$ in this state is referred to as the minimum meshing width.

While the pump rotational speed N is between the first rotational speed $N_A$ and the second rotational speed $N_B$, the axial movement of the gear holder 110 is not restricted, and therefore, it moves and stops at predetermined positions in the front side space 13 in correspondence to the balancing of the biasing force against the pressing force. Because the biasing force and the pressing force act on the gear holder 110 in the opposite directions, offsetting each other, no load from the biasing force and the pressing force acts on the driven shaft 60. Therefore, the gear holder 110 never moves in the up and down or right and left directions.

The following is a summary of beneficial effects achieved by the oil pump 1 according to the present invention. Firstly, because the gear holder 110 is provided coaxially with driven shaft 60 in cross-sectional view, the gear holder 110 can be minimized around the driven shaft 60, which leads to a miniaturization of the oil pump 1. Furthermore, the miniaturization of the gear holder 110 makes the pressing force required for the axially sliding of the gear holder 110 smaller and in turn makes the biasing force, which acts against the pressing force, also smaller. As a result, the return spring 6 can take a smaller design, too. In this way, the oil pump 1 can be downsized even further.

Secondly, because the necessary pressing force is acquired by leading oil into the ring-shaped narrow enclosed space 25, which is provided coaxially to the driven shaft 60 in cross-sectional view, the pressing force can act axially on the gear holder 110 in an evenly balanced manner. As a result, the changing of the meshing width δ is performed smoothly.

Thirdly, because the front part of the ring part 121 of the gear holder 110, which is supporting the driven gear 61 rotatable by the outer periphery of ring part 121, is press-fit forward from the rear into the opening 112 of the front wall 111 and fixed therein, the front wall 111, the ring rear wall 120 and the driven gear 61 are united as if they were in a one-piece body. This rigidity works to prevent any change in the opposing distance between the driven-side first side face 2*g* and the driven-side second side face 2*h* of the driven-side pump chamber 2*e*. As a result, the efficiency in the operation of the oil pump 1 can be maintained without any adversity like, for example, oil leaks, which may otherwise occur if the opposing distance is somehow lengthened, or an increase in the friction of the gear holder sliding, which may otherwise occur if the opposing distance is somehow shortened.

Fourthly, because the driven gear 61 is made movable axially by the pressure of the oil discharged into the enclosed space 25 acting on the rear bottom surface 131*b* of the gear holder 110 as the pressing force and the return spring 6 generating the biasing force acting on the gear holder in the opposite direction, the pump capacity is variably controlled by using the pressure of the discharged oil. As a result, the discharge flow rate Q is easily controlled stable regardless of increases and decreases in the rotational speed N of the pump.

Fifthly, for this variable control, the inner passage 133, which connects the discharge port 5 and the enclosed space 25 in fluid communication, is provided internally inside the piston part 130. The provision of the inner passage 133 involves only the inside of the piston part 130, so the inner passage 133 can be easily provided. Moreover, this design does not require sealing members, which may be otherwise required if such a passage is provided by using a plurality of members. Therefore, the oil pump 1 can be manufactured with a relatively small production cost.

Sixthly, the oil pump 1 can be manufactured in a reduced number of manufacturing steps and with a reduced manufacturing cost. In a prior art oil pump, for positioning the front casing 10 and the rear casing 20 with respect to each other and putting them together, pin holes are opened at two positions for dowels to be inserted. However, in the present invention, the insertion of the driven shaft 60 into the driven shaft support bore 12 is used advantageously for the positioning, omitting one of the two positions where dowel holes were otherwise drilled.

The invention claimed is:

1. A gear pump comprising:

a first gear, which is fixed on a freely rotatable first support shaft and which rotates together with said first support shaft;

a second gear, which is supported rotatable on a second support shaft disposed parallel to said first support shaft and which meshes with said first gear; and a casing, which provides an installation space for accommodation of said first gear and said second gear and which supports said first support shaft rotatable and supports said second support shaft;

wherein:

said casing is provided with an intake port, which is in fluid communication with said installation space, and with a discharge port, which is in fluid communication with said installation space;

said first gear and said second gear meshing with each other are rotated by the rotation of said first support shaft, so that a fluid is sucked through said intake port into said gear pump and discharged therefrom through said discharge port;

said gear pump further comprises a gear holder, which supports said second gear rotatable and holds both sides of said second gear in said installation space, said gear holder being supported and mounted axially movable on said second support shaft; and while said gear holder is being subjected to an axial biasing force from a biasing member provided on one side in an axial direction of the second support shaft, said gear holder is subjected also to a pressing force that acts against said biasing force, on the other side in the axial direction of the second support shaft, which results in said gear holder holding said second gear being moved in the axial direction of the support shafts.

2. A gear pump according to claim 1, wherein:

said gear holder comprises one side wall that includes a ring-shaped shank part and a cylindrical side wall part, and a tubular other side wall;

said second gear is supported rotatable on said shank part, so that one side face of said second gear is in close contact with said one side wall while the other side face of said second gear is in close contact with said other side wall; and said one side wall or said other side wall is provided with a piston, which generates said pressing force.

3. A gear pump according to claim 2, wherein:

said gear holder is provided with an internal flow passage, which connects, in fluid communication, said discharge port to an enclosed space provided on a back side of said piston; and when said piston is subjected to the fluid pressure being supplied through said internal flow passage into said enclosed space, said piston generates said pressing force.

4. A gear pump according to claim 3, wherein either one of said one side wall and said other side wall is provided with an inwardly curved arc-like curve surface, for said gear holder not to interfere with said first gear when said gear holder moves axially on said second support shaft.

5. A gear pump according to claim 4, wherein said curved surface has a shape that is substantially identical to a rotational path of tooth ridges of said first gear.

6. A gear pump according to claim 2, wherein either one of said one side wall and said other side wall is provided with an inwardly curved arc-like curve surface, for said gear holder not to interfere with said first gear when said gear holder moves axially on said second support shaft.

7. A gear pump according to claim 6, wherein said curved surface has a shape that is substantially identical to a rotational path of tooth ridges of said first gear.

* * * * *